US007131256B2

(12) United States Patent
Drost

(10) Patent No.: US 7,131,256 B2
(45) Date of Patent: Nov. 7, 2006

(54) METHOD AND DEVICE FOR TWISTING OF TWO ENDS OF THREAD

(75) Inventor: Roelf Johannes Drost, Losser (NL)

(73) Assignee: Paper Enschede B.V., Enschede (NL)

( * ) Notice: Subject to any disclaimer, the term of this patent is extended or adjusted under 35 U.S.C. 154(b) by 20 days.

(21) Appl. No.: 10/473,852

(22) PCT Filed: Mar. 28, 2002

(86) PCT No.: PCT/NL02/00201

§ 371 (c)(1),
(2), (4) Date: Mar. 17, 2004

(87) PCT Pub. No.: WO02/079035

PCT Pub. Date: Oct. 10, 2002

(65) Prior Publication Data

US 2004/0148920 A1 Aug. 5, 2004

(30) Foreign Application Priority Data

Apr. 2, 2001 (NL) ..... 1017759

(51) Int. Cl.
*B65H 69/06* (2006.01)

(52) U.S. Cl. ..... 57/22

(58) Field of Classification Search ..... 57/22, 57/23, 202, 261, 263
See application file for complete search history.

(56) References Cited

U.S. PATENT DOCUMENTS

| | | | | |
|---|---|---|---|---|
| 3,667,377 | A | 6/1972 | Persson | |
| 3,898,924 | A | 8/1975 | Mead et al. | |
| 4,167,902 | A | 9/1979 | Bister et al. | |
| 4,732,180 | A | 3/1988 | Fixel | |
| 6,032,575 | A | 3/2000 | Johnson | |
| 6,170,247 | B1 * | 1/2001 | Ragnoli et al. | 57/22 |
| 6,199,475 | B1 | 3/2001 | Schwelling | |

FOREIGN PATENT DOCUMENTS

EP 0 808 771 A1 11/1997

* cited by examiner

*Primary Examiner*—Shaun R. Hurley

(57) ABSTRACT

A method and a device for twisting at least two ends of thread in order to mutually connect the at least two threads, which method comprises the steps of: providing at least two ends of thread running substantially mutually parallel and in the same direction; holding the threads fixedly at a first position at a distance from the ends of thread; rotating the ends of thread on a rotation axis running substantially parallel to the ends of thread; and reducing the distance between the first position and the ends of thread in order to create a thread twist.

3 Claims, 7 Drawing Sheets

METHOD AND DEVICE FOR TWISTING OF TWO ENDS OF THREAD

BACKGROUND OF THE INVENTION

1. Field of the Invention

The invention relates to a method for twisting at least two ends of thread in order to mutually connect the at least two threads.

2. Description of the Related Art

In the processing of, among other things, waste paper, cardboard waste etc., it is usual to press the waste into bales which can then be readily transported to for instance a paper factory, an incinerator etc. This waste may for instance consist of plastic, paper or grass.

Such bales are pressed in a bale pressing machine. The waste is tipped for this purpose into a channel, whereafter a ram displaceable in the channel compacts the waste tipped into the channel. The compacted material is subsequently carried to a tying station. It is usual at the moment to tie up the bales with steel thread. In order to mutually connect the ends of a binding thread these ends are twisted together. This possible as a result of the properties of steel thread.

In view of the changing requirements in respect of the delivery of bales to for instance incinerators, there is a resulting desire for bales to be supplied without steel thread. This is because after incineration steel thread is left behind in the ash and must then be processed separately, or the steel has an adverse effect on such bundled material for the fodder industry The drawback of the present bale-pressing machines is that they are only suitable for steel thread. Threads of other material cannot be applied in such machines.

SUMMARY OF THE INVENTION

In order to obviate this drawback the invention provides a method for twisting at least two ends of thread, wherein threads in a wide diversity of materials can be used. This method according to the invention comprises the steps of:

providing at least two ends of thread running substantially mutually parallel and in the same direction;

holding the threads fixedly at a first position at a distance from the ends of thread;

rotating the ends of thread on a rotation axis running substantially parallel to the ends of thread; and reducing the distance between the first position and the ends of thread in order to create a thread twist.

By carrying the ends of thread in the direction of the first position the tension in the ends of thread is limited at the position of the twist. It hereby becomes possible to also use materials other than just steel.

According to a preferred embodiment of the method according to the invention the carrying of the ends of thread in the direction of the first position takes place during rotation of the ends of thread. The creation of the twist can hereby be controlled.

In another preferred embodiment of the method, according to the invention the providing of the at least two ends of thread comprises the steps of;

providing at least two threads running mutually parallel;

holding the at least two threads fixedly at two positions at a distance from each other;

severing the at least two threads between the two positions such that at each of the two positions at a distance from each other there are provided at least two, ends of thread for twisting.

Particularly in the case of bale-pressing machines it is advantageous to twist two pairs of ends of thread at the same moment. Thus the closing twist can for instance be made for a first bale, while the starting twist for a subsequent bale can simultaneously be made.

Very highly recommended is a method wherein the threads are plastic threads. These plastic threads can be of a clean-burning plastic, such as for instance polyethylene. This means that when the waste is burnt in a waste incinerator the plastic threads can also be incinerated and there remains no residual waste.

The invention further comprises a device for performing the method according to the invention. This device comprises:

first feed means for feeding a first thread;

second feed means for feeding a second thread;

rotation means for rotating the first and second thread together around a rotation axis running parallel to the threads;

cutting means for severing both the first and the second thread; and holding means for fixedly holding the first and the second thread on either side and at a distance from the cutting means.

The rotation means, cutting means and holding means are preferably arranged in a displaceable frame. This enables a simple replacement of components during repair or modification of existing machines.

The frame is preferably tiltable away from and to the first and second threads. The frame can further be displaceable in longitudinal direction of the threads. The forming of the twist can thus be controlled.

BRIEF DESCRIPTION OF THE DRAWINGS

These and other features of the invention are further elucidated with reference to the annexed drawings.

FIG. 1 shows a bale-pressing machine 1 which comprises a device according to the invention and performs the method according to the invention.

DETAILED DESCRIPTION OF THE INVENTION

Figure 1:
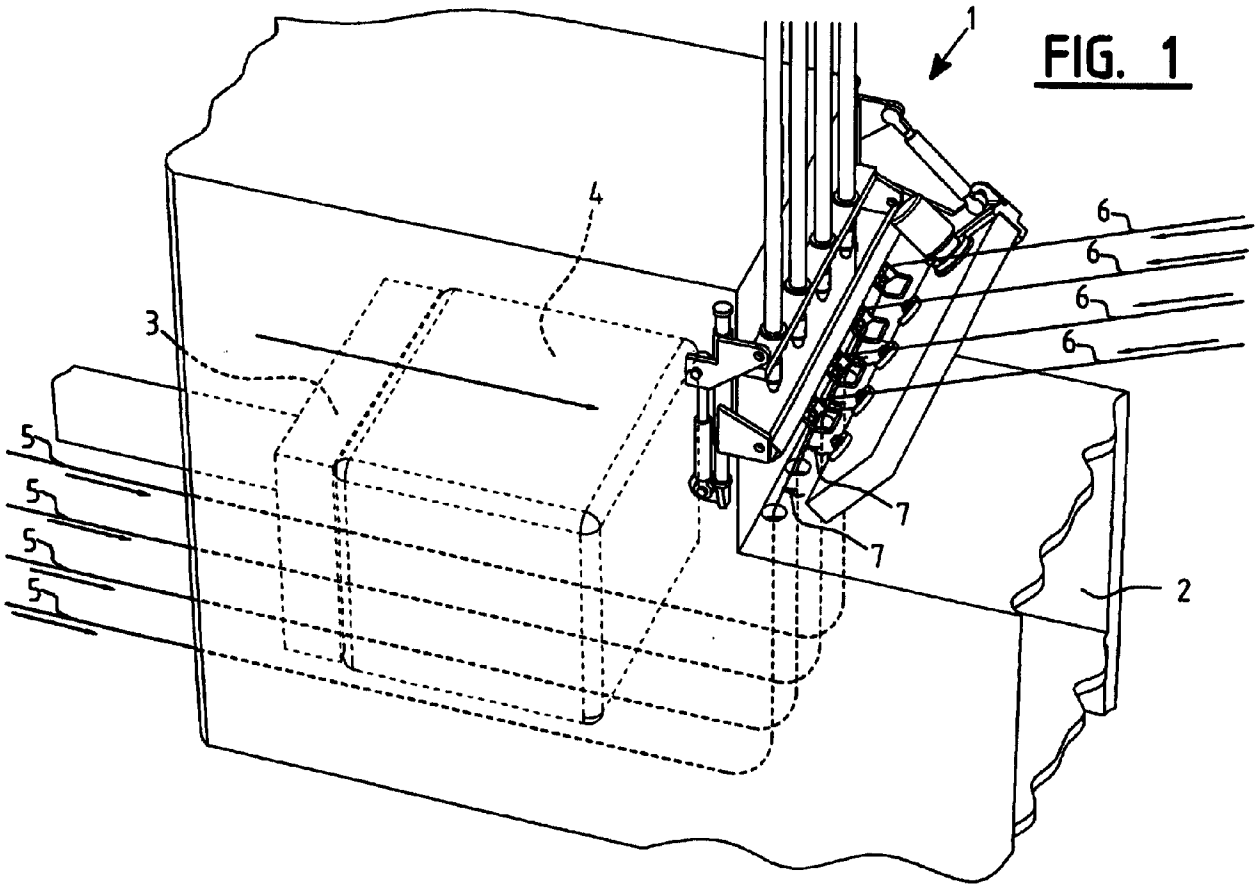
FIGS. 1–6 show in perspective view a device according to the invention at different stages during performing of the method according to the invention.

This bale-pressing machine has a pressing channel 2 in which a displaceable ram 3 is arranged. Waste is tipped into this pressing channel 2 and subsequently compacted by means of displaceable ram 3 to form a bale 4. Four first threads are fed under pressing channel 2. From above and in opposite direction are fed four second threads 6. Each first thread 5 is connected by means of a twist 7 to a second thread 6.

Figure 2:
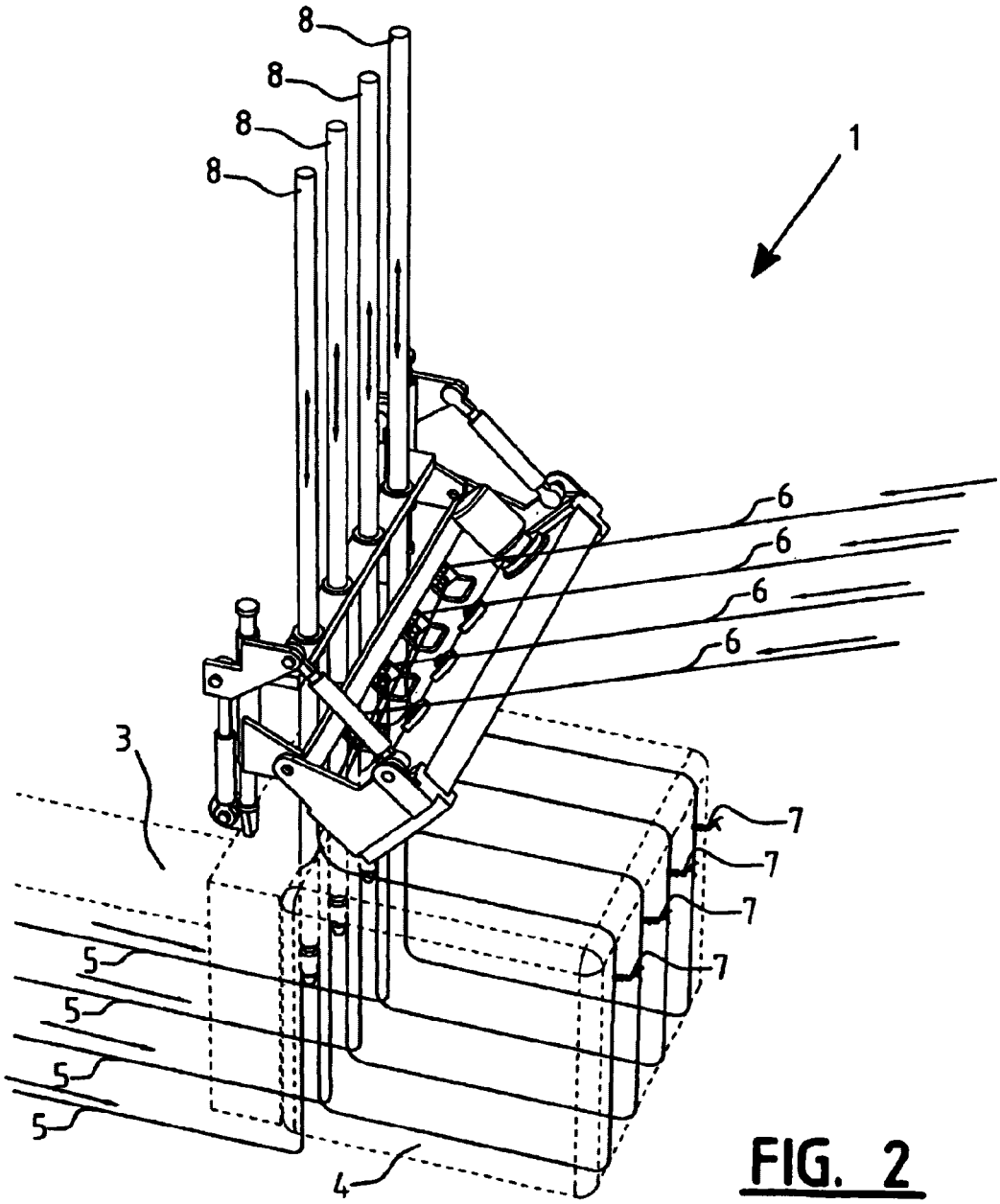

In FIG. 2 the ram 3 is displaced further so that the first and second threads 5, 6 lie on the top, front and bottom side of bale 4. In this position four needles 8 are carried downward to grasp the first threads 5 and to carry them upward on the rear side of bale 4.

Figure 3:
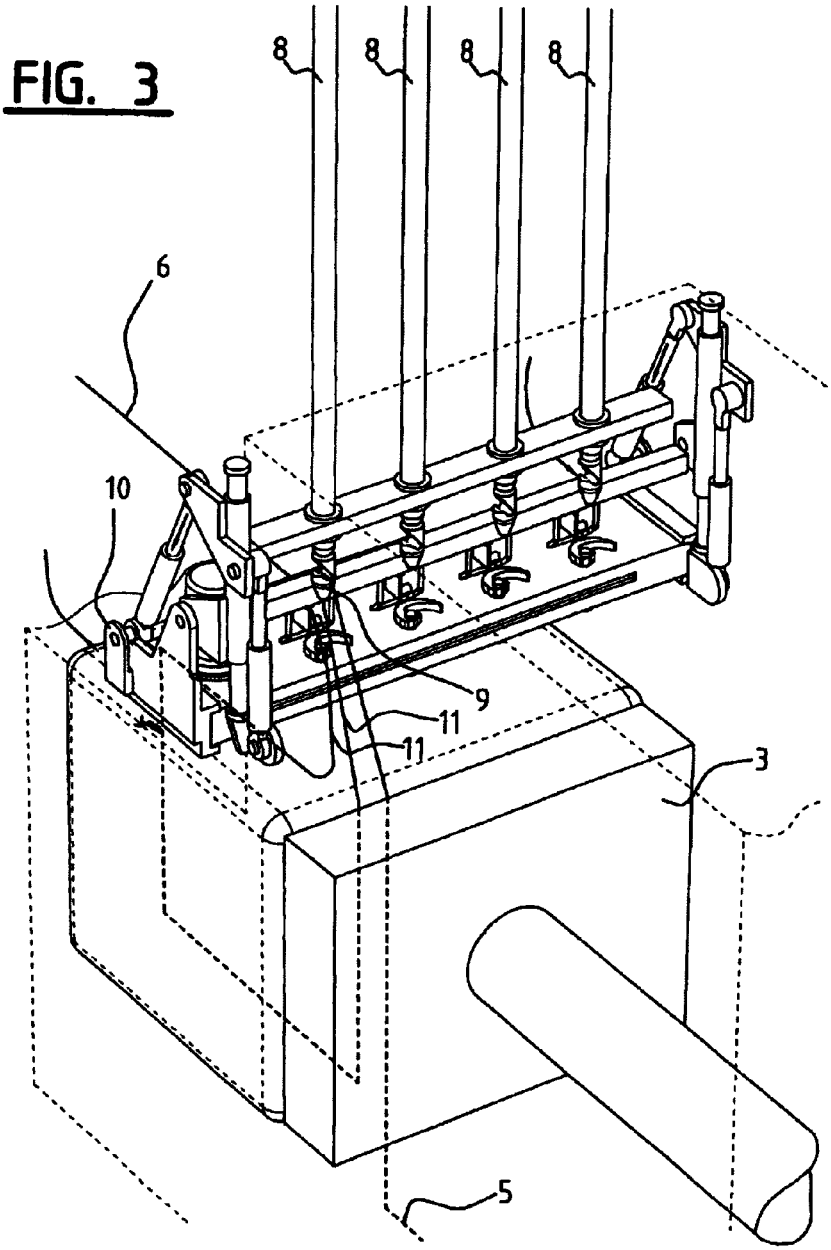
Figure 4:
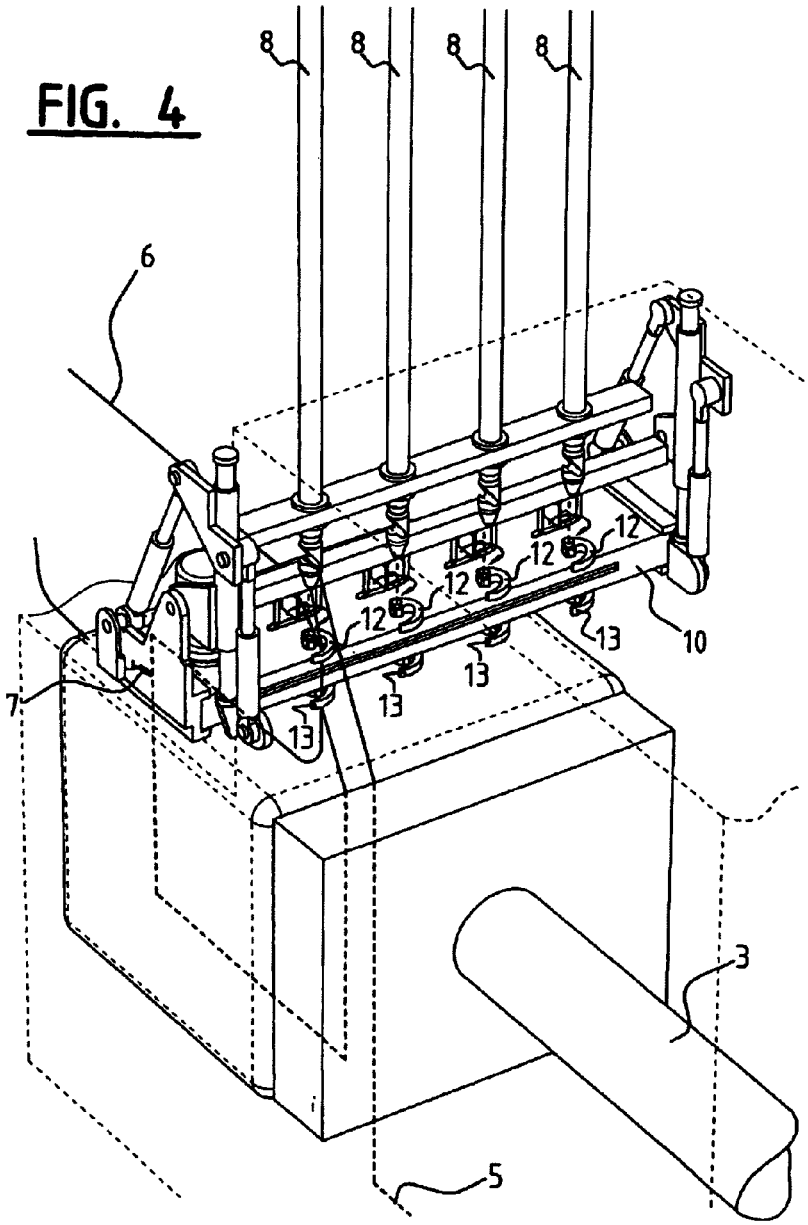

In FIG. 3 the needles a have returned to their upper position. The first thread 5 now runs via the head 9 of needle 8 so that at least a part of first thread 5 and second thread 6 run mutually parallel. A frame 10 is then tilted against these parallel parts. A number of rotatable upper fingers 12 and lower fingers 13 are arranged on this frame 10. These upper and lower fingers 12 and 13 are then rotated to bring together the parallel parts 11 of threads 5 and 6. These are then clamped fixedly between frame 10 and fingers 12 and 13.

Figure 5:
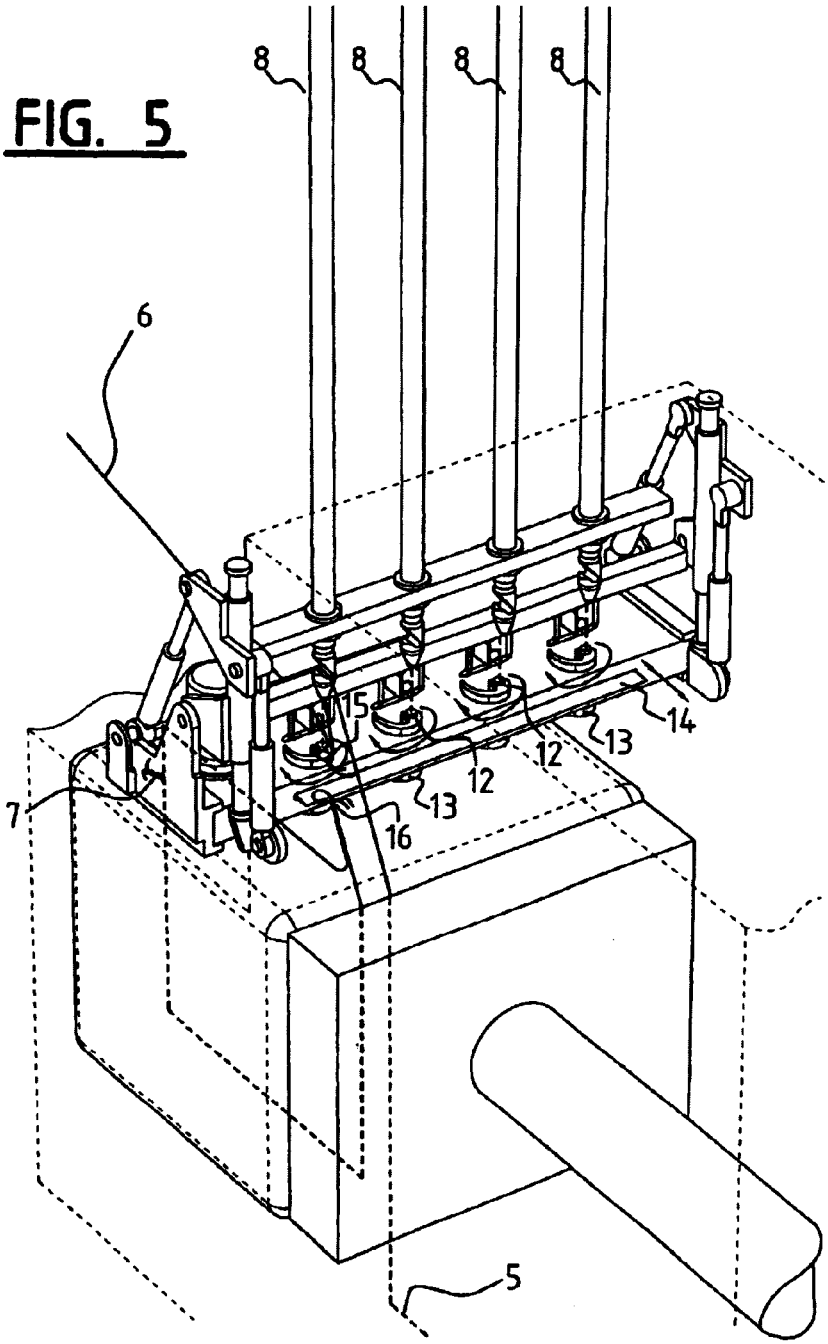

Referring to FIG. 5, a knife part 14 now comes into operation which severs the parallel parts 11. For each first and second thread 5, 6 there thus results two pairs of ends 15, 16 which are clamped respectively under an upper finger 12 and a lower finger 13. These fingers are then rotated through a number of revolutions so that the beginning of a twist is formed.

Figure 6:
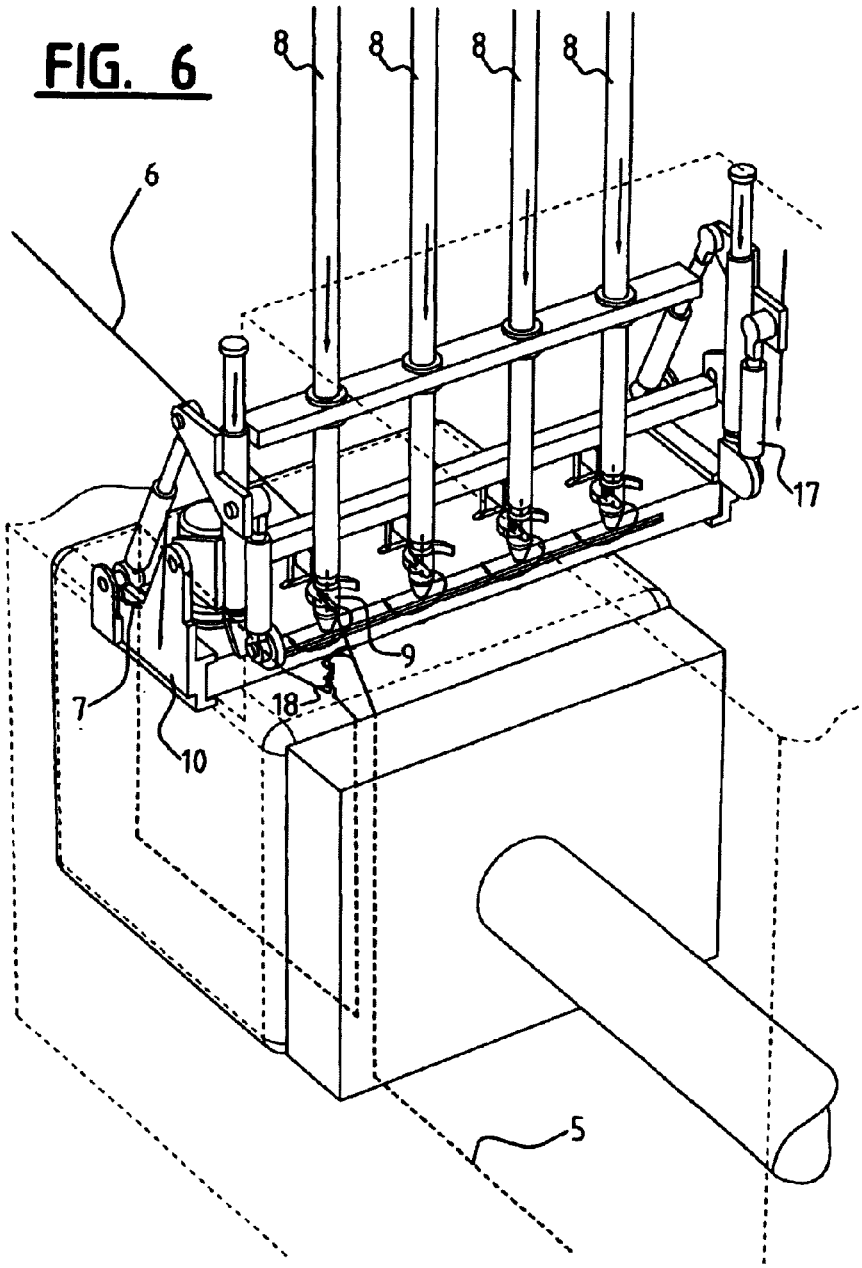

While fingers 12 and 13 continue to rotate, frame 10 is lowered in vertical direction by means of a cylinder 17 (see FIG. 6). Needles 8 are herein displaced through a distance equalling twice the displacement of frame 10. The distance between fingers 12 and 13 and the location where the threads are held, on the one side by bale 4 and on the other by needle head 9, is thus reduced. The forming of the twist is hereby controlled. A second twist 18 is thus created in the thread arranged around bale 4. First thread 5 and second. thread 6 are further connected to each other again by means of a twist 7. Needles 8 are subsequently carried slightly further downward, whereafter needle heads 9 can rotate and can thereby release the thread 5 again. The above stated cycle then takes place again.

Figures 7A, 7B:
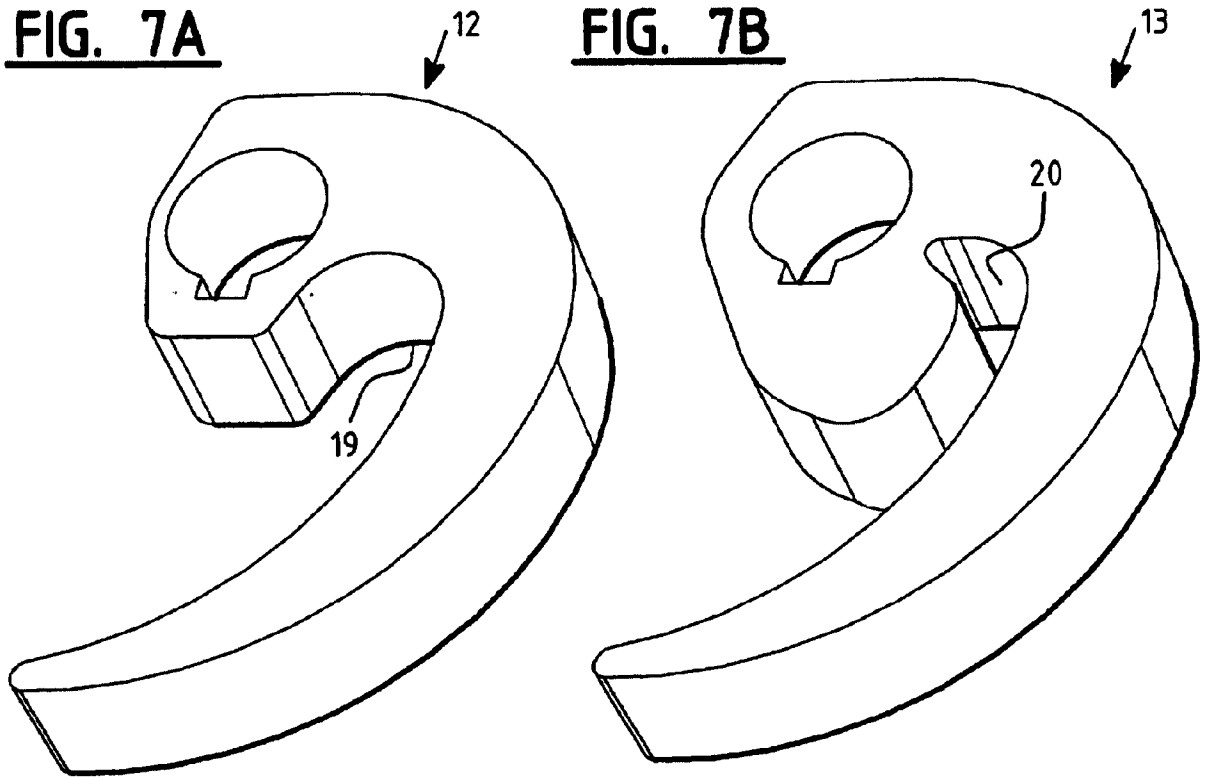
FIGS. 7*a* and 7*b* show in perspective view two fingers with which the threads can be gripped and rotated.

FIGS. 7*a* and 7*b* show respectively upper finger 12 and lower finger 13. Upper finger 12 and lower finger 13 are of different design in the shown preferred embodiment. It has been found from tests that with this specific device this design of upper and lower fingers 12, 13 gives a good result. The parallel parts 11 of threads 5 and 6 are gripped in the recesses 19, 20 of the finger. A part of the threads is then pulled under the finger, whereby they become fixed thereunder.

The above described method is particularly suitable for plastic threads. On the one hand it prevents the twist of plastic threads from untwisting and on the other it prevents the twist breaking off the threads. These advantages are achieved mainly because the distance between the position where the threads are held and the ends of thread is reduced.

The invention claimed is:

1. A method for twisting at least two ends of thread in order to mutually connect the at least two threads, which method comprises the steps of:

providing at least two threads running substantially mutually parallel;

holding the at least two threads fixedly at two positions at a distance from each other;

severing the at least two threads running substantially in the same direction between the two positions such that at each of the two positions at a distance from each other there are provided at least two ends of thread;

holding the threads fixedly at a first position at a distance from the ends of thread;

rotating the ends of thread on a rotation axis running substantially parallel to the ends of thread; and reducing the distance between the first position and the ends of thread in order to create a thread twist.

2. The method as claimed in claim 1, wherein the reducing of the distance between the first position and the ends of thread takes place during rotation of the ends of thread.

3. The method as claimed in claim 1, wherein the threads are plastic threads.

* * * * *